United States Patent [19]

Denner et al.

[11] Patent Number: 4,550,650

[45] Date of Patent: Nov. 5, 1985

[54] HOOD FOR THE EXTRACTION OF GASES, VAPORS AND SUSPENDED MATTER

[75] Inventors: Wolf J. Denner; Andreas Biernacki; Günter Breitschwerdt, all of Stuttgart, Fed. Rep. of Germany

[73] Assignee: Waldner Laboreinrichtungen GmbH & Co., Fed. Rep. of Germany

[21] Appl. No.: 471,817

[22] Filed: Mar. 3, 1983

[30] Foreign Application Priority Data

Mar. 10, 1982 [DE] Fed. Rep. of Germany ..... 3208622

[51] Int. Cl.[4] ..... F24F 9/00

[52] U.S. Cl. ..... 98/115.3; 98/36

[58] Field of Search ..... 98/115 LH, 36, 40 N

[56] References Cited

U.S. PATENT DOCUMENTS

| | | | |
|---|---|---|---|
| 3,021,776 | 2/1962 | Kennedy | 98/36 X |
| 3,023,688 | 3/1962 | Kramer, Jr. | 98/36 |
| 3,408,914 | 11/1968 | Bayern | 98/115 LH |
| 4,123,967 | 11/1978 | Shanis | 98/36 |

FOREIGN PATENT DOCUMENTS

| | | | |
|---|---|---|---|
| 567039 | 9/1957 | Italy | 98/36 |

*Primary Examiner*—William E. Wayner

*Attorney, Agent, or Firm*—Sixbey, Friedman & Leedom

[57] ABSTRACT

The hood for the extraction of gases, vapors and suspended matter comprises a hood casing, a supply air feed device and one or more suction outlets. It serves preferably as a laboratory hood. In the vicinity of the front suction inlet is provided at least one nozzle ledge for the supply air, whose outlet port is directed in the plane of the front suction inlet. At least one suction outlet is provided, which extracts in the direction of the axis of the vortex flow. According to a preferred embodiment, there are two suction outlets and two facing nozzle ledges. The nozzle ledges can have a rectangular cross-section, the front side being constructed as an outlet port. There is a constant reduction in the nozzle cross-section.

14 Claims, 7 Drawing Figures

HOOD FOR THE EXTRACTION OF GASES, VAPORS AND SUSPENDED MATTER

Figure 1A:
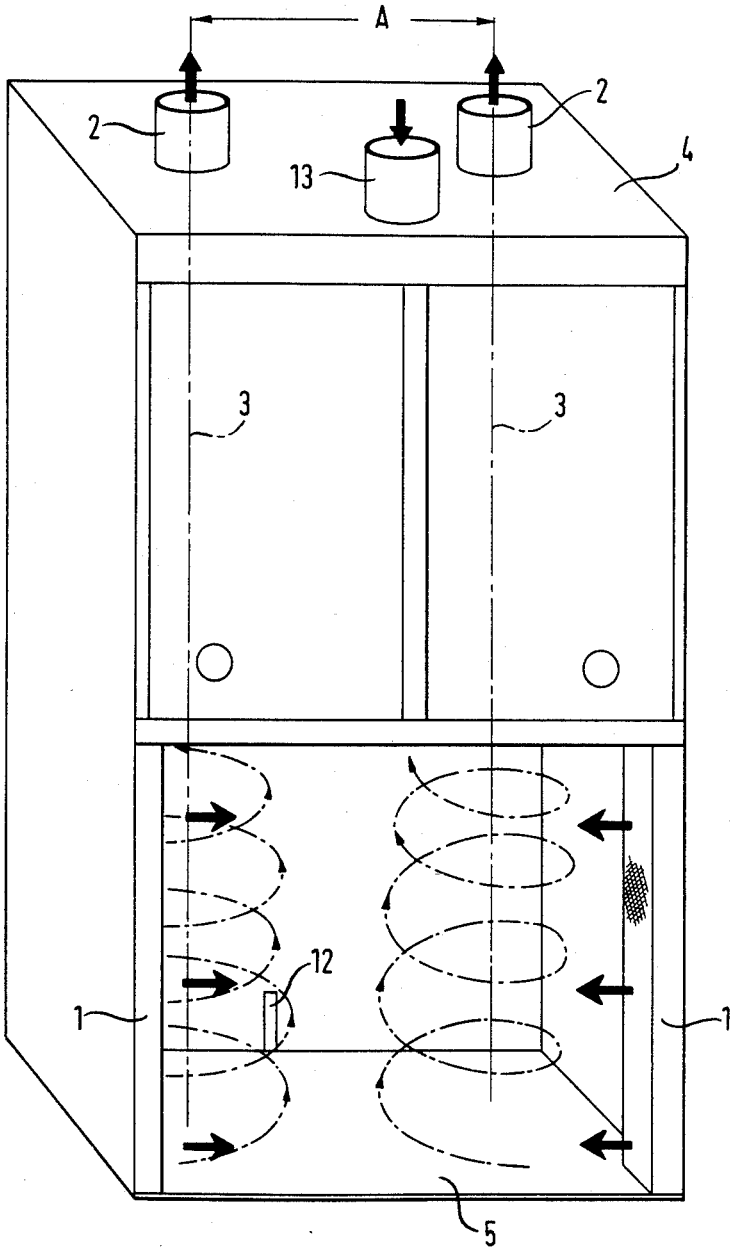

The invention relates to a hood for the extraction of gases, vapors and suspended matter, particularly, a laboratory hood.

Known laboratory hoods remove the air, which conveys the pollutants falling on the working surface, from the surrounding laboratory area, in that the laboratory air is sucked in by means of an extractor fan in the vicinity of the front slide member and/or via the openings provided or, when the slide member is closed, via a bypass.

It is also known to provide laboratory hoods with a direct supply air connection in the top area enabling air to be sucked in by an exhaust fan. These hoods differ from conventional hoods without a supply air device in that, when the front slide member is closed and consequently with a restricted air supply from the laboratory area, air is sucked in via the supply air connection due to the vacuum in the hood. However, the air is largely taken from the laboratory, when the front slide member is open.

Laboratory hoods are also known, in which the supply air is blown out in front of the front slide member in such a way that it is sucked in to the hood with the slide member wholly or partly open.

It is also known from DE-OS No. 2659736 to provide an air supply device on the leading edge of a laboratory hood. This has the advantages that air intermixing is relatively limited, the pollutants are conveyed into the front area of the laboratory hood and parts of the contaminated air are circulated.

The requisite air flow rate of conventional laboratory hoods is defined in DIN No. 12924 and VDI guideline No. 2051 (F.R. of Germany). To prevent pollutant escapes with the front slide member wholly or partly open, DIN No. 12924 requires an ambient air inlet velocity of at least 0.7 m/s with the front slide member open by 100 mm. This means that the hourly volume flow extracted in commercial laboratory hoods is at least 400 $m^3/h$ of air. This high air flow rate is an important cost factor for the operator of the hood, because this air is taken from the laboratory area and must then be returned thereto through a corresponding air conditioning system. More particularly when a plurality of hoods are arranged within a laboratory area, high air changes occur (up to 20 air changes per hour), so that the laboratory personnel are constantly exposed to draughts. However, if the air extracted from the laboratory hood is not taken from the laboratory area and is instead additionally blown into the hood, in the case of a suitable construction of the flow field there can be both an encapsulation and extraction of the pollutants in the hood, whilst also avoiding draughts in the laboratory, so that the laboratory air conditioning system can have a much smaller capacity.

The problem of the invention is therefore to provide a hood, permitting the blowing in of supply air with a much higher percentage (approximately 80%) than hitherto (approximately 40%), without there being any escapes of pollutants.

According to the invention this problem is solved by providing at least one nozzle ledge within the hood for supplying air in the plane of the suction inlet of the hood, and by providing a respective suction outlet for extracting air from the hood in the direction of an axis of a respective vortex flow formed in the hood between the nozzle ledge and suction outlet.

The invention is based on the finding that a pure displacement flow, produced by blowing in supply air at a random point of the laboratory hood, leads to pollutant escapes when the front side member is open, because the inlet velocity of the ambient air is reduced by the additional air blown in and consequently, e.g. with a completely open front slide member with an opening surface of 1 $m^1$, in the case of 400 $m^3/h$ of extracted air and 80% supply air, is only approximately 0.02 m/s, so that even minor disturbances due to draughts or persons moving past it can lead to the mixing out of pollutants.

In order to protect the front of the laboratory hood with the front slide member open, the air velocity in the vicinity of the slide member must be increased in the manner of a laminar aerial fog, which is influenced by producing a rotational field within the hood in such a way that it is completely taken up by the laboratory hood.

The invention is described in greater detail hereinafter relative to non-limitative embodiments and the attached drawings, wherein show:

FIG. 1*a* a diagrammatic front view of a hood according to claims 1 and 2.

Figure 1B:
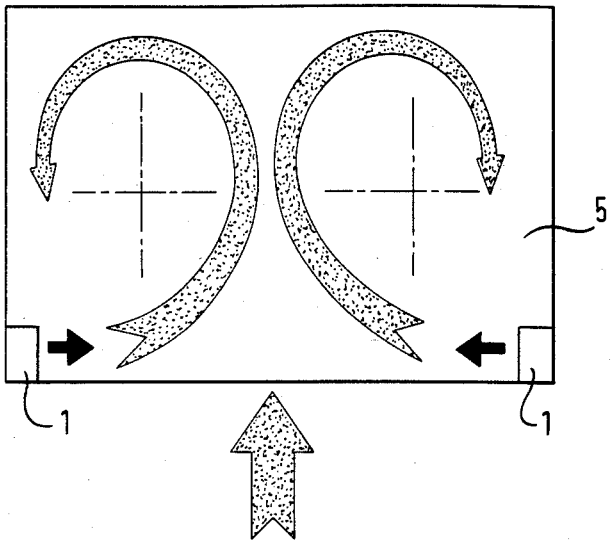

FIG. 1*b* a plan view of the rotational field.

Figure 2A:
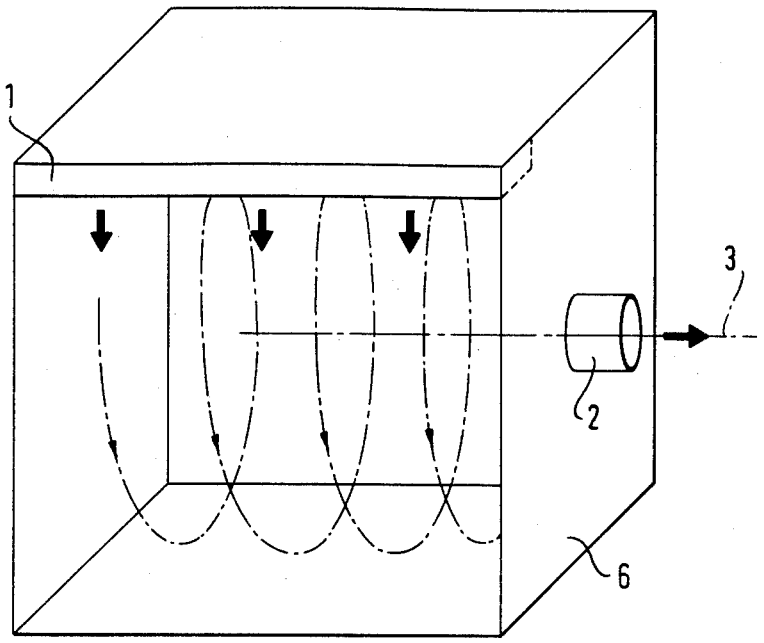

FIG. 2*a* a diagrammatic view of a hood according to claim 4.

Figure 2B:
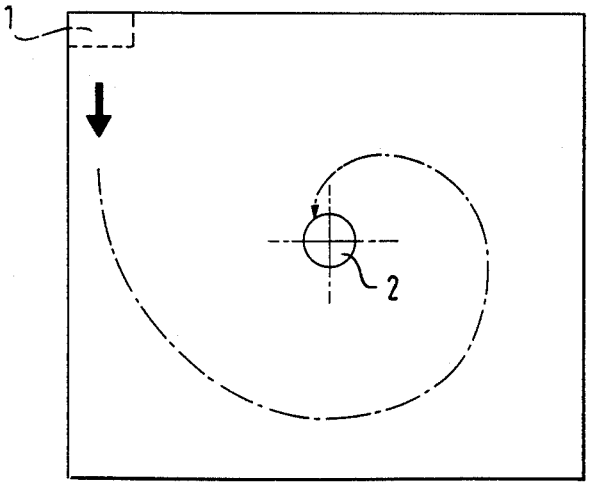

FIG. 2*b* a side view of the hood according to claim 4.

Figure 3:
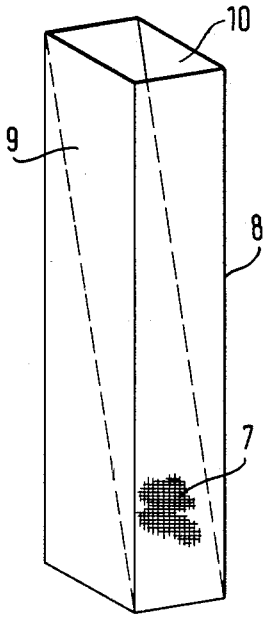

FIG. 3 a perspective view of a nozzle ledge according to claim 5.

Figure 4A:
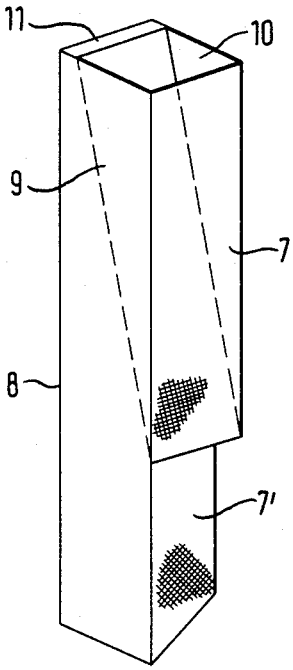

FIG. 4*a* a perspective view of a nozzle ledge according to claim 6.

Figure 4B:
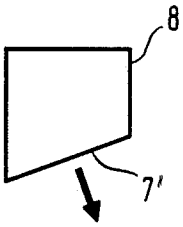

FIG. 4*b* a section through the lower part of the nozzle ledge.

According to one embodiment, the rotational field is produced in a partly open laboratory hood in that in the vicinity of the front slide member are fitted on either side vertical laminar nozzles, whose blow-out direction is towards the vertical axis of the slide plate (cf. FIG. 1). By means of two suction outlets arranged with a spacing A in the top area of the hood and in conjunction with the laterally blowing-in nozzles, two vertically directed, oppositely rotating tubular vortexes are produced, whose centre has a vertically upwardly directed velocity component, so that the pollutants in the working area are conveyed towards the suction outlets.

The rotation direction of each vortex, is determined by the blow-out direction of the associated nozzle (cf. FIG. 1*b*). The production of the vortexes prevents a flush or obtuse meeting of the two laterally occurring air curtains, because as a result of the superimposed rotational field, they acquire a velocity component directed into the hood.

The suction outlets can also be located on the hood base plate, preferably when it is frequently necessary to work with heavy gases.

In addition, the hood can be constructed in such a way that the rotational fields are horizontally directed (cf. FIG. 2), the suction outlets being provided on one side wall or the in each case facing side walls. The nozzle ledges are then positioned horizontally over and/or under the suction inlet with a vertically upwards or downwards blow-on direction.

The hood can also be constructed in such a way that by means of a single suction outlet in the centre of one side wall, in conjunction with a nozzle ledge positioned horizontally above or below the suction inlet, a single rotational field is produced in the hood and on the axis thereof, the pollutants are conveyed to the suction outlet.

The nozzle ledges have a roughly rectangular or square cross-section (cf. FIG. 3), and are provided on their front side with an outlet port, which corresponds to the entire width of the ledge. The outlet port is covered by a flow resistance means, e.g. a wire cloth. In order to obtain a uniform velocity distribution of the air flowing out of the ledge, the nozzle body contains a sloping plate in such a way that the nozzle cross-section constantly decreases for the supply air in the downstream direction.

An improvement on the inflow conditions in the hood can be obtained in that in the bottom area thereof, the interface formed there is directed into the hood. This is brought about by bending the lower part of the nozzle ledge in such a way that the rectangular shape in the upper part passes into a trapezoidal shape (FIG. 4). As the air passes out at right angles to the plane of the wire cloth stretched over the ledge (FIG. 4*b*), this gives a different outflow direction between the upper and lower parts of the nozzle ledge. The outflow direction of the lower part must be directed into the inner area of the hood. This subdivision of the nozzle requires a separate air supply for the upper and lower parts thereof and is achieved by a slot between the rear wall of the nozzle and the sloping plate in the upper part thereof.

An improvement of the velocity distribution in the sense of making it more uniform over the entire front surface, can be achieved by giving the sloping plate in the nozzle a rough surface area (e.g. a felt covering, felt mats, etc.). This has an advantageous effect on the formation of the rotational fields.

A stabilization of the vortexes and an improved extraction of heavy gases in the bottom area can be achieved by providing a roughly 4 mm wide and 100 mm high vertical slot in the centre of the rear hood wall and which is connected to the suction pipe (cf. claim 8).

The air supply for the nozzle ledges can be separate for each nozzle body, but can also be effected by a common line 13, which must have a branch for the left and right nozzle. To achieve a uniform vortex distribution in the hood, the branch must be such that a slide member or wedge makes it possible to adjust the air quantities of the facing nozzle ledges on istalling the hood.

We claim:

1. Hood for the extraction of gases, vapors, and suspended matter, particularly a laboratory hood, comprising a hood casing, a supply air feed device, at least one suction outlet, supply air being supplied at least partly from the ambient air through a connection from the hood casing to the external air, wherein the supply air feed device includes at least one nozzle ledge that is lcoated within the hood and has a discharge outlet directed in the plane of a front suction inlet of the hood, and wherein each said suction outlet is located within said hood in association with a respective said nozzle ledge in a manner producing a vortex air flow therebetween in such a way that air is extracted by the suction outlet in the direction of the axis of the vortex flow produced, characterized in that two suction outlets (2) are arranged on the cover plate (4), whilst two nozzle ledges (1), arranged vertically, on the side walls are provided and the discharge outlets of said ledges are directed counter to one another, the discharge outlets of the ledges and suction outlets being arranged with respect to each other in such a way as to produce a pair of oppositely rotating, vertical axis, tubular vortexes.

2. Hood according to claim 1, characterized in that the suction outlets (2) are arranged on an end plate (5).

3. Hood according to claim 1, characterized in that the nozzle ledge (1) comprises a nozzle casing (8) with an approximately rectangular cross-section, that the front side (7) is constructed as an outlet port, which is covered with a large-area flow resistance means, and that in the nozzle casing (8) is provided a plate (9) which, starting at the inlet port (10), constantly decreases the nozzle cross-section for the supply air.

4. Hood according to claim 1, wherein the hood has an interior work space that is closable at a front face, forming said suction inlet, by a front slide member, said nozzle ledge being vertically oriented interiorly of said front face and the discharge outlet thereof being directed parallel to the plane of said front face, and wherein the axis of said suction outlet is vertical.

5. Hood for the extraction of gases, vapors, and suspended matter, particularly a laboratory hood, comprising a hood casing, a supply air feed device, at least one suction outlet, supply air being supplied at least partly from the ambient air through a connection from the hood casing to the external air, wherein the supply air feed device includes at least one nozzle ledge that is located within the hood and has a discharge outlet directed in the plane of a front suction inlet of the hood, and wherein each said suction outlet is located within said hood in association with a respective said nozzle ledge in a manner producing a vortex air flow therebetween in such a way that air is extracted by the suction outlet in the direction of the axis of the vortex flow produced, characterized in that a vertical slot (12) is provided in the centre of the rear hood wall above a base plate (5) and extends over approximately 10% of the hood height.

6. Hood for the extraction of gases, vapors, and suspended matter, particularly a laboratory hood, comprising a hood casing, a supply air feed device, at least one suction outlet, supply air being supplied at least partly from the ambient air through a connection from the hood casing to the external air, wherein the supply air feed device includes at least one nozzle ledge that is located within the hood and has a discharge outlet directed in the plane of a front suction inlet of the hood, and wherein each said suction outlet is located within said hood in association with a respective said nozzle ledge in a manner producing a vortex air flow therebetween in such a way that air is extracted by the suction outlet in the direction of the axis of the vortex flow produced, characterized in that the nozzle ledge (1) has an approximately rectangular cross-section in the upper area, that the front side (7) is constructed as an outlet port covered with a large-area flow resistance means, that a plate (9) is arranged in the nozzle casing (8) which constantly reduces the nozzle cross-section in the upper area, that in the lower area the cross-section is trapezoidal in such a way that the outlet port (7') is at an angle to the outlet port (7) and that the supply air for outlet port (7') is guided through a slot (11) between plate (9) and the rear wall of the nozzle.

7. Hood according to claim 6, characterized in that the plate (9) has a rough surface.

8. Hood according to claim 7, wherein said rough surface is formed by a felt covering.

9. Hood according to claim 5, wherein said resistance means is a wire cloth.

10. Hood according to claim 9, characterized in that two suction outlets (2) are arranged on the cover plate (4), whilst two nozzle ledges (1), arranged vertically, on the side walls are provided and outlet ports of said ledges are directed counter to one another.

11. Hood according to claim 9, characterized in that the suction outlets (2) are arranged on an end plate (5).

12. Hood according to claim 6, characterized in that two suction outlets (2) are arranged on the cover plate (4), whilst two nozzle ledges (1), arranged vertically, on the side walls are provided and outlet ports of said ledges are directed counter to one another.

13. Hood according to claim 6, characterized in that the suction outlets (2) are arranged on an end plate (5).

14. Hood according to claim 6, characterized in that a vertical slot (12) is provided in the centre of the rear hood wall above a base plate (5) and extends over approximately 10% of the hood height.

* * * * *